US005412842A

United States Patent [19]

Riblett

[11] Patent Number: 5,412,842

[45] Date of Patent: May 9, 1995

[54] DETENT HINGE

[75] Inventor: Allen Riblett, Ardentown, Del.

[73] Assignee: Southco, Inc., Concordville, Pa.

[21] Appl. No.: 143,539

[22] Filed: Oct. 26, 1993

Related U.S. Application Data

[63] Continuation of Ser. No. 820,149, Jan. 13, 1992, abandoned.

[51] Int. Cl.[6] ..... E05D 11/10

[52] U.S. Cl. ..... 16/334; 16/322

[58] Field of Search ..... 16/322, 321, 327, 326, 16/297, 334

[56] References Cited

U.S. PATENT DOCUMENTS

| | | | |
|---|---|---|---|
| D. 269,943 | 8/1983 | Bisbing . | |
| D. 278,309 | 4/1985 | Vickers . | |
| D. 284,931 | 8/1986 | Bisbing . | |
| D. 303,491 | 9/1989 | Bisbing . | |
| D. 303,492 | 9/1989 | Bisbing . | |
| 324,444 | 8/1885 | Wolf | 16/322 |
| 2,591,476 | 4/1952 | Swanson | 16/54 |
| 4,439,888 | 4/1984 | Merillat . | |
| 4,490,884 | 1/1985 | Vickers . | |
| 4,501,045 | 2/1985 | Boyer . | |
| 4,630,333 | 12/1986 | Vickers . | |
| 4,897,873 | 1/1990 | Beutler et al. | 16/325 |
| 4,987,640 | 1/1991 | Lin . | |
| 5,020,189 | 6/1991 | Grome et al. . | |

FOREIGN PATENT DOCUMENTS

| | | | |
|---|---|---|---|
| 1321501 | 2/1963 | France | 16/342 |
| 816066 | 10/1951 | Germany | 16/334 |
| 0124838 | 5/1985 | Germany . | |
| 376389 | 5/1964 | Switzerland . | |
| 404854 | 1/1934 | United Kingdom | 16/322 |
| 1391215 | 4/1975 | United Kingdom . | |
| 2052618 | 1/1981 | United Kingdom . | |
| 2125497 | 3/1984 | United Kingdom . | |
| 2193528 | 2/1988 | United Kingdom . | |
| 2224538 | 5/1990 | United Kingdom . | |

OTHER PUBLICATIONS

Southco Fasteners Handbook 40 (Southco, Inc. Pennsylvania 1990) P. M1-M12.

*Primary Examiner*—P. Austin Bradley
*Assistant Examiner*—Chuck Y. Mah
*Attorney, Agent, or Firm*—Paul and Paul

[57] ABSTRACT

A detent hinge supports a vertically or horizontally swinging door to the frame. The detent hinge releasably retains the door in a predetermined position relative to the frame when the door is rotated to open or to close.

18 Claims, 2 Drawing Sheets

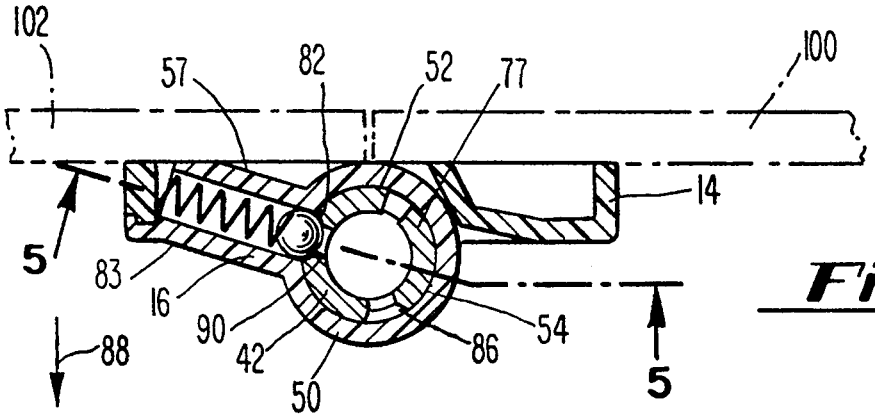
Fig. 4
Fig. 4a
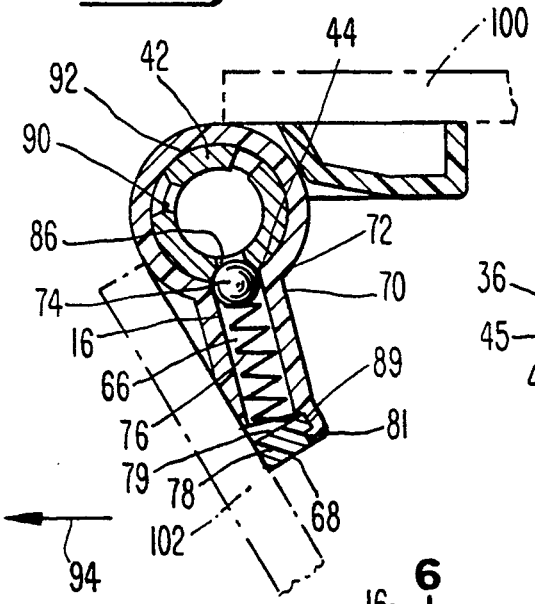
Fig. 6
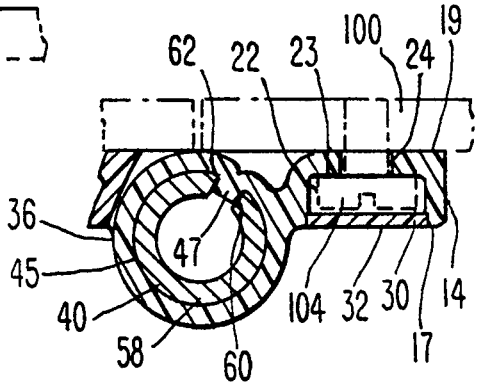
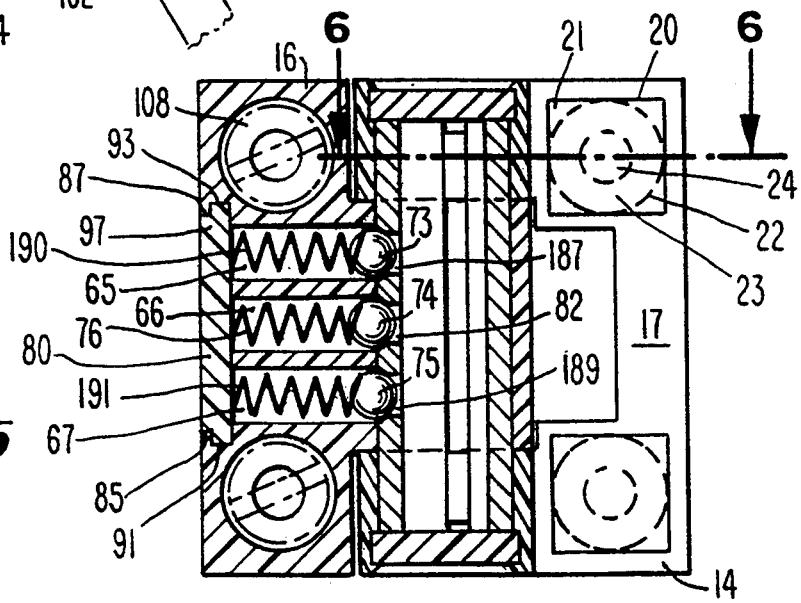
Fig. 5

DETENT HINGE

This application is a continuation of application Ser. No. 820,149, filed Jan. 13, 1992, now abandoned.

BACKGROUND OF THE INVENTION

1. Field of the Invention

The present invention relates generally to hinge devices for supporting doors, lids, covers and the like and more particularly to hinge devices which retain a door, lid, cover and the like in an opened or closed position relative to a frame.

2. Brief Description of the Prior Art

Various types of hinge devices which function to retain a door, lid, cover and the like in an opened or closed position are known. Some types used on vertically swinging kitchen cabinet doors exert a torque in order to retain the door in a closed position. However, the amount of torque provided from the hinge is not sufficient in some circumstances to retain the door in the closed position in response to inadvertent contact forces. In addition, these types of hinges do not function to retain the door in an opened position. Another type of hinge used on vertically swinging doors incorporates a wave shaped cam surface which allows the door to rest in either an opened or closed position. However, the opened or closed positioning of the hinge is limited to the location of the downward sloped portion of the cam surface. In addition, the application of the hinge is limited to vertically swinging doors since the weight of the door on the cam surface functions to position the hinge. Still another type of hinge in common use incorporates an adjustable knuckle member which generates a torque upon a hinge pin in order to retain a vertically or horizontally swinging door in an opened position. However, the torque which is generated by adjustment of a screw member creates drag throughout the entire range of motion of the hinge. In addition, the hinge has a tendency to spring open slightly when the door is closed, thus requiring an additional latch to retain the door in the closed position.

There is a need for a hinge assembly which will securely retain a vertically or horizontally swinging door in any predetermined position relative to a frame.

SUMMARY OF THE INVENTION

The present invention provides a detent hinge for supporting a vertically or horizontally swinging door to a frame. The detent hinge releasably retains the door in a predetermined position relative to the frame as the door is rotated to open or to close. The detent hinge has detented positions to hold a door opened or closed. High torque is required to move the door out of the detented position while low torque is required to move the door between detented positions. The detent hinge includes a hinge assembly and a pin assembly. The hinge assembly includes a first hinge means secured to the frame and a second hinge means secured to the door. The detent hinge further includes means for releasably retaining the second hinge means in response to rotation of the door. In a presently preferred embodiment, the releasable retaining means includes means for releasably engaging the pin assembly in response to rotation of the door. Preferably, the releasable engaging means comprises at least one biased member disposed within the hinge assembly, but many comprise a plurality of biased members. The number of biased members provided will vary the torque produced by the hinge. For example, a plurality of biased members will generate higher torques, which are often needed to maintain a door in an opened position when the detent hinge is applied to horizontally swinging doors. In addition, the pin assembly preferably includes means releasably receiving the releasable engaging means in response to rotation of the door. The releasable receiving means comprises at least one aperture formed in an outer surface of the pin assembly; preferably, a plurality of apertures are provided. Each aperture will releasably retain the door in a position relative to the frame dependent upon the location of the aperture. The aperture can be located at any angle upon the pin assembly.

Advantageously, the present invention comprises a detent hinge which will retain a door in any predetermined position relative to a frame.

It is a further advantage of the present invention to provide a detent hinge which will produce varying amounts of torque to accommodate application to either vertically or horizontally swinging doors.

BRIEF DESCRIPTION OF THE DRAWINGS

FIG. 4 is a sectional plan view of the detent hinge of FIG. 3 taken on the line 4—4.

FIG. 4A is a sectional plan view showing the detent hinge of FIG. 4 in an open position.

FIG. 5 is a sectional front elevational view of the detent hinge of FIG. 1.

FIG. 6 is a sectional plan view of the detent hinge of FIG. 5 taken along the line 6—6.

DETAILED DESCRIPTION

Figure 1:
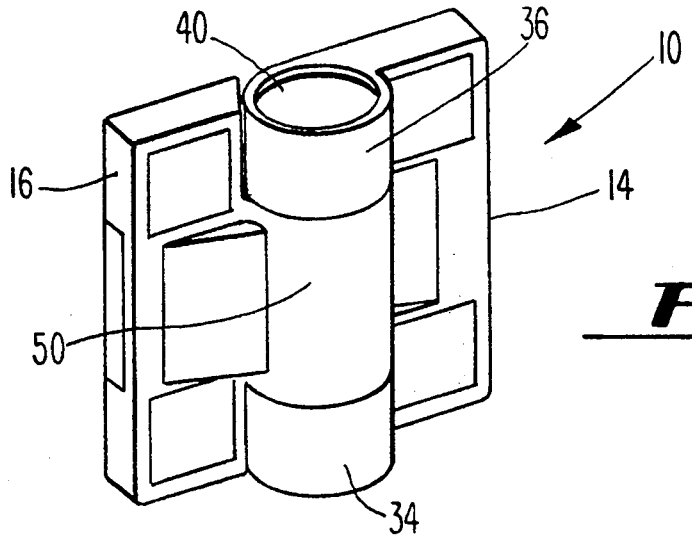
FIG. 1 is a perspective view of a detent hinge according to the present invention.

Referring now to the drawings in detail wherein like reference numerals indicate like elements throughout the several views, there is shown in FIG. 1 a perspective view of a detent hinge 10 of the present invention. The detent hinge 10 comprises a two-part hinge assembly which includes a first hinge means comprising a first hinge leaf 14 and a second hinge means comprising a second hinge leaf 16. In the top plan views of FIGS. 2 and 4A, the first hinge leaf 14 is shown secured to the frame 100 while the second hinge leaf 16 is shown secured to the rotatable door 102. However, these positions may be reversed so that the second hinge leaf 16 is secured to the frame 100 and the first hinge leaf 14 is secured to the rotatable door 102.

Figure 2:
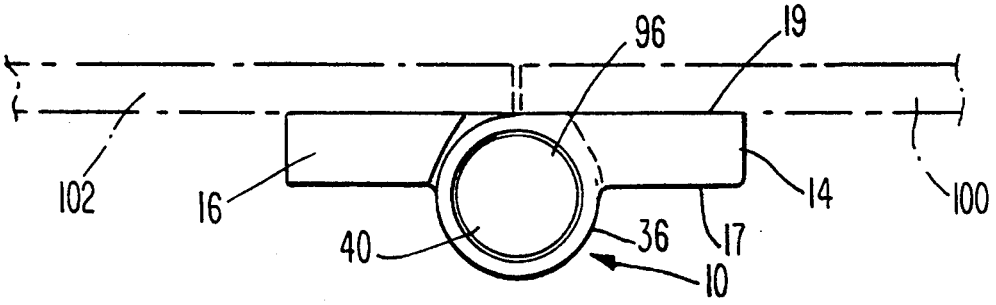
FIG. 2 is a top plan view of the detent hinge of FIG. 1 shown installed on a door and frame.

While the detent hinge 10 of the present invention is shown in FIG. 2 on doors which swing on vertical hinges, the detent hinge of the present invention can be used in other applications, such as on doors, lids or covers which swing on horizontally disposed hinges and which, when the door, lid or cover is raised to gain access to the interior, are intended to remain in a predetermined raised position without falling down.

As shown in FIG. 2, the first hinge leaf 14 is provided with a substantially flat base having an upper surface 17 and a lower surface 19. As best seen in the sectional front elevation view of FIG. 5, the upper surface 17 is provided with a pair of first depressions 20, square in shape, forming first seats 21. The first seats 21 are further provided with second depressions 22, cylindrical in shape, forming second seats 23. Extending through the flat base from the second seats 23 to the outer surface 19 are through holes 24, for accommodating screws 104 which seat squarely against the second seats 23 for fastening the first hinge leaf 14 to the frame 100, as seen in FIG. 6. Covers 30, square in shape, are adapted to snap-fit within the first seats 21 to conceal the screws 104. The covers 30 are provided with an upper surface 32 which is positioned flush with the upper surface 17 of the flat base when the covers 30 are received within first seats 21, as seen in FIGS. 5 and 6.

As shown in FIG. 1, the first hinge leaf 14 also includes a pair of spaced apart knuckles 34 and 36, each of which having a central bore, 38 and 40, respectively (only one of which is visible in FIG. 1). In a presently preferred embodiment, bores 38 and 40 are substantially circular in cross-section for the purpose of receiving the pin assembly described below. As best seen in FIG. 6, the knuckles 34 and 36 (only one of which is visible in FIG. 6) have inner surfaces 44 and 45, respectively, within the bores 38, 40. Bosses 46 and 47 (only one of which is visible) are formed extending inward from the inner surfaces 44 and 45 for a purpose described below.

As shown in FIG. 1, the second hinge leaf 16 includes a detent knuckle 50 which is complimentally configured and inserted into the space between the two knuckles 34 and 36 of the first hinge leaf 14. As best seen in FIG. 4, the detent knuckle 50 is provided with a central bore 52, circular in cross-section, having an inner surface 54 for the purpose of receiving the cylindrical pin assembly 42 for rotational movement within bore 52. Second hinge leaf 16 is also provided with a substantially flat base having an upper surface 83 and a lower surface 57. As shown in FIG. 5, the flat base further includes means for receiving the screws 108 in the same manner as that described in relation to the first hinge leaf 14, to fasten the second hinge leaf 16 to the door 102.

Figure 3:
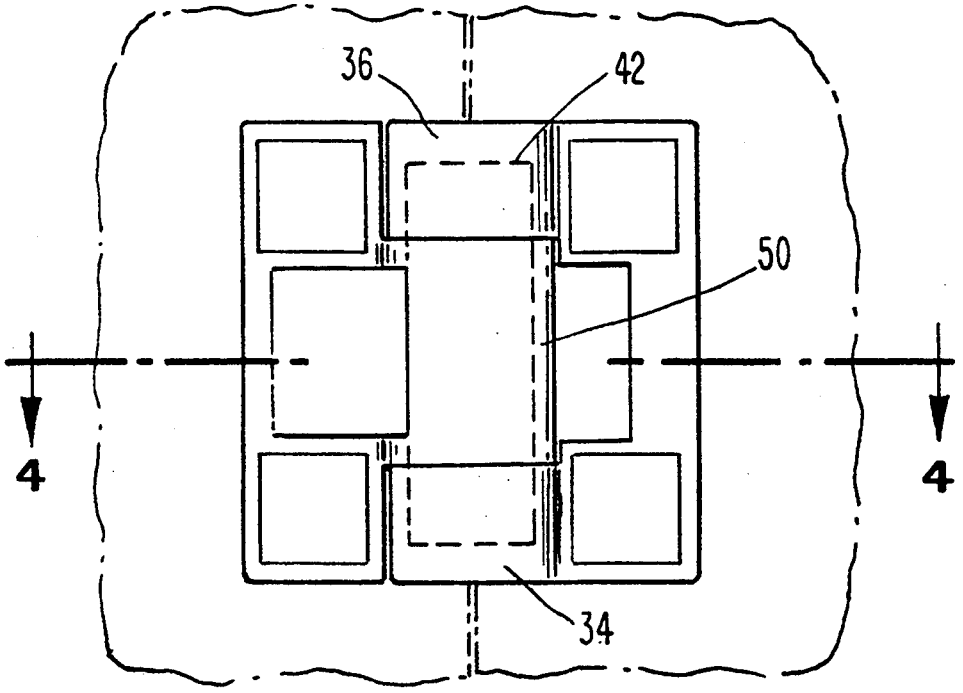
FIG. 3 is a front elevational view of the detent hinge of FIG. 1.

As illustrated in phantom in FIG. 3, the pin assembly 42 is received within the knuckles 34 and 36 of the first hinge leaf 14, and the detent knuckle 50 of the second hinge leaf 16. As best seen in FIG. 6, the pin assembly 42 is comprised of a square stamping which is formed to provide a substantially cylindrical hinge pin 58. The hinge pin 58 includes a pair of spaced apart parallel end portions 60 and 62 forming an elongated slot. The elongated slot is press-fit onto bosses 46 and 47 as the pin assembly 42 is received within bores 38, 40, thereby preventing rotation of the pin assembly 42 within the first hinge leaf 14. It is to be understood, however, that the bores 38 and 40 could be formed having a non-circular cross section, such as a square, rectangle, octagonal, or other non-circular shape to accommodate a non-circular portion of a pin assembly for preventing rotation of the pin assembly 42 within the first hinge leaf 14.

The pin assembly 42 of the present invention is produced from steel stock, however, it should be understood that the pin assembly 42 can be made of any suitable material without departing from the present invention.

As shown in FIG. 2, plugs 96 and 98 (not shown) are adapted to be received within bores 38, 40 in the first and second knuckles 34, 36 to conceal the pin assembly 42.

The detent hinge 10 is further provided with means for releasably retaining the second hinge leaf 16 in response to rotation of the door 102. In accordance with the present invention, the second hinge leaf 16 has means for releasably engaging the pin assembly 42. As seen in FIGS. 4*a* and 5, the second hinge leaf 16 is provided with an outer surface 68, and inner surface 70 adjacent the detent knuckle 50. An aperture 78, rectangular in shape, is formed within the outer surface 68 of the second hinge leaf 16. The aperture 78 is comprised of a lower surface 79 parallel with outer surface 70, a top surface 81 parallel with upper surface 83, and two opposing side surfaces 85 and 87 perpendicular with the top surface 81. At least one opening 66 is formed through the second hinge leaf 16 from the lower surface 79 to the inner surface 70, and into the detent knuckle 50, from an outer surface 72 to the inner surface 44. At least one biased member 74 is shown disposed within the at least one opening 66 to engage the pin assembly 42. A first biasing means 76 urges the at least one biased member to contact the outer surface 77 of the pin assembly 42. Top surface 81 and side surfaces 85, 87 of the outer surface 68 are provided with longitudinally connecting grooves 89, 91 and 93, respectfully, forming a channel. A tab 97 is adapted to be received by the channel to retain the at least one biased member 74 and first biasing means 76 within the at least one opening 66. However, tab 97 is slideable within the channel in order to enable the removal or insertion of the at least one biased member 74. Tab 97 has an outside surface 80 and an inside surface 79, with the outside surface 80 positioned flush with outer surface 68 of the second hinge leaf 16 when received by the channel. The inner surface 25 of tab 97 (not shown) is provided with at least one arch shaped slot formed therein for receiving the first biasing means 76.

The pin assembly 42 is provided with means for releasably receiving the second hinge leaf 16. The pin assembly 42 is formed with the outer surface 77 having at least one aperture 82 formed therein. The at least one aperture 82 is adapted to receive the at least one biased member 74 in response to rotation of the door when the door 102 is in a closed position. As shown in FIG. 4, the at least one aperture 82 is positioned just a few degrees beyond the position that the door 102 would be in when closed against the frame 100. Thus, the door when closed will have a tendency to remain closed by exerting a force against the frame. In a presently preferred embodiment, the pin assembly 42 is provided with a plurality of apertures 82 comprising an adjacent second aperture 86 spaced 120 degrees from the at least one aperture 82 for retaining the door open at 120 degrees. However, the adjacent second aperture 86 can be located at any angle on the pin assembly 42. For example, the second aperture 86 may be located at 85 degrees or 155 degrees or any other angle from the aperture 82 to retain the door in the open position.

As shown in FIG. 4, upon rotation of the door 102 by an operator in the direction of arrow 88, the at least one biased member 74, comprising a steel ball, will pass over the edge 90 of the at least one aperture 82 and slide along the outer surface 77 of the pin assembly 42 until engaging the adjacent second aperture 86, as illustrated in FIG. 4A. Upon rotation of the door 102 in FIG. 4A in the direction of arrow 94, the steel ball will disengage adjacent second aperture 86 and will slide in the opposite direction in the same manner as described above to engage the at least one aperture 82. It is to be understood, however, that the pin assembly 42 may be provided with any number of adjacent apertures 82 for retaining the door in any position.

As shown in FIG. 5, in a presently preferred embodiment, the second hinge leaf 16 is provided with a plurality of vertically aligned openings 65, 66 and 67 to accommodate a plurality of biased members 73, 74 and 75 and a plurality of biasing means 190, 76, and 191 for releasably engaging a first plurality of vertically aligned apertures 82, 187 and 189 and an adjacent second plurality of vertically aligned apertures 86, 188, and 192 (not visible in FIG. 5). The first vertically aligned apertures 82, 187, and 189 being positioned to engage the biased members 73, 74, and 75 when the door 102 is in the closed position, and the adjacent second vertically aligned apertures 86, 188 and 192 positioned to engage the biased members 73, 74, and 75 when the door is positioned 120 degrees in the open position. The biased members 73, 74, and 75 and biasing means 190, 76 and 191, in the preferred embodiment, generate a torque upon the pin assembly 42 in the area of 25 inch-pounds. It should be understood, however, that the detent hinge 10 may be provided with any number of at least one openings 66, and any number of at least one biased members 74 for providing more or less torque for engaging the pin assembly 42.

The first and second hinge leaves 14, 16 of the present invention can be produced by conventional techniques, such as, injection molding from thermoplastic or thermosetting materials. It should be understood, however, that the first and second hinge leaves 14, 16 can be made of any suitable material, without departing from the present invention.

It will be recognized by those skilled in the art that changes may be made to the above-described embodiments of the invention without departing from the broad inventive concepts thereof. It is understood, therefore, that this invention is not limited to the particular embodiments disclosed, but it is intended to cover all modifications which are within the scope and spirit of the invention as defined by the appended claims.

I claim:

1. A detent hinge for supporting a vertically or horizontally positioned door to a frame, the detent hinge releasably retaining the door in a predetermined position relative to the frame as the door is rotated to open or to close, the detent hinge comprising a hinge assembly including a first hinge means secured to the frame and a second hinge means secured to the door, each of the first and second hinge means having at least one bore therethrough, a pin assembly disposed within the bores of the first and second hinge means for connecting the hinge assembly for rotatable movement and including at least one aperture formed in an outer surface thereof, at least one bearing member disposed within the hinge assembly adapted for contacting the outer surface of the pin assembly and at least one biasing means adapted for biasing the bearing member in the direction of the pin assembly for contacting the outer surface for providing a predetermined amount of force thereon, wherein a corresponding amount of torque is required for rotation of the door, whereby upon rotation of the door in a first direction by an operator, the at least one bearing member will be moved against the outer surface of the pin assembly to engage the at least one aperture formed in the outer surface for retaining the door in a first position, and upon rotation of the door in a second direction by an operator, the at least one bearing member will disengage that at least one aperture for releasing the door, the detent hinge further including a predetermined number of bearing members and biasing means disposed within the hinge assembly, with each bearing member being in contact with the outer surface of the pin assembly, wherein the hinge assembly includes means for varying the predetermined number of bearing members and biasing means disposed within the hinge assembly for adjusting the amount of torque required for rotation of the door.

2. The detent hinge according to claim 1, including at least a second aperture formed in the outer surface of the pin assembly positioned at a predetermined spaced separation from the at least one aperture thereof adapted for releasably receiving the at least one bearing member for releasably retaining the door in a second position.

3. The detent hinge according to claim 1, wherein the means for varying the predetermined number of bearing members and biasing means comprises a plurality of openings extending through the hinge assembly from an outer surface thereof through to the pin assembly, with each opening being capable of receiving a bearing member and a biasing means, and a retaining member cooperatively associated with the hinge assembly and operatively movable relative thereto between a closed position and an open position, whereby when the retaining member is in the closed position, the bearing members and biasing means are confined within the hinge assembly by the retaining member, whereby movement of the retaining member from the closed position to the open position provides access to the plurality of openings for varying the number of bearing members and biasing means disposed within the plurality of openings extending through the hinge assembly.

4. The detent hinge according to claim 3, wherein the retaining member includes an inner surface in engagement with the predetermined number of biasing means when the retaining member is in the closed position.

5. The detent hinge according to claim 4, wherein the retaining member includes a perimeter surface, wherein at least a portion of the perimeter surface is slidably engageable with the hinge assembly.

6. The detent hinge according to claim 1, wherein the means for varying the predetermined number of bearing members and biasing means disposed within the hinge assembly includes means for insertion and removal of a desired number of bearing members and biasing means.

7. A detent hinge for supporting a vertically or horizontally positioned door to a frame, the detent hinge releasably retaining the door in a predetermined position relative to the frame as the door is rotated to open or to close, the detent hinge comprising a hinge assembly secured to the door and the frame, and a pin assembly, a) the hinge assembly including: a first hinge means for retaining the pin assembly, a second hinge means for receiving the pin assembly for rotational movement, and at least one biased member for engaging the pin assembly adapted for providing a predetermined amount of force thereon, wherein a corresponding amount of torque is required for rotation of the door, and b) the pin assembly including means releasably receiving the at least one biased member in response to rotation of the door;

c) the detent hinge further including means for adjusting the amount of torque required for rotation of the door for maintaining the vertical or horizontal position thereof, wherein the adjusting means comprises a plurality of openings extending through the hinge assembly from an outer surface thereof through to the pin assembly, with each opening being capable of receiving a biased member, and a retaining member cooperatively associated with the hinge assembly and operatively movable relative thereto between a closed position and an open position, whereby movement of the retaining member from the closed position to the open position provides access to the plurality of openings for either insertion of a desired number of biased members, removal of a desired number of biased members, or insertion and removal of a desired number of biased members.

8. The detent hinge according to claim 7, wherein the releasable receiving means comprises at least one aperture formed in an outer surface of the pin assembly.

9. The detent hinge according to claim 8, comprising a predetermined number of apertures formed in the outer surface of the pin assembly adapted for releasably receiving the predetermined number of biased members.

10. The detent hinge according to claim 7, wherein the retaining member includes a perimeter surface, wherein at least a portion of the perimeter surface is slidably engageable with the hinge assembly.

11. A detent hinge for supporting a vertically or horizontally positioned door to a frame, the detent hinge releasably retaining the door in a predetermined position relative to the frame as the door is rotated to open or to close, the detent hinge comprising:

a) a first hinge leaf having first and second knuckles at spaced separation, each of the first and second knuckles having a bore therethrough defining an inner surface, the inner surfaces including bosses extending therefrom, b) a second hinge leaf having a base, the base including an upper surface and an outer surface, and a detent knuckle extending from an inner surface of the base, the detent knuckle being inserted into the space between the first and second knuckles of the first hinge leaf, the detent knuckle having an outer surface and a circular bore therethrough defining an inner surface, and at least one opening extending through the base, from the outer surface to the inner surface, and into the detent knuckle, from the outer surface to the inner surface, c) a cylindrical pin assembly comprising: a hinge pin having an elongated slot therein adapted to be received by the bosses of the first and second knuckles of the first hinge leaf, as the pin assembly is received within the bores in the first and second knuckles of the first hinge leaf and circular bore of the second hinge leaf, and an outer surface, the outer surface having at least one aperture formed therein, and d) at least one biased member comprising a substantially spherical bearing member in association with a biasing means, each disposed within the at least one opening through the base and into the detent knuckle of the second hinge leaf, the at least one biased member contacting the outer surface of the pin assembly adapted for providing a predetermined amount of force thereon, wherein a corresponding amount of torque is required for rotation of the door, whereby upon rotation of the door in a first direction by an operator, the at least one biased member will engage the at least one aperture in the outer surface of the pin assembly to retain the door in a first position, and upon rotation of the door in a second direction by an operator, the at least one biased member will disengage the at least one aperture;

e) the detent hinge further comprising means adapted for adjusting the amount of torque required for rotation of the door for maintaining the vertical or horizontal position thereof, wherein the hinge assembly comprises a predetermined number of bearing members and biasing means disposed therein and the adjusting means comprises means for varying the predetermined number of bearing members and biasing means disposed within the hinge assembly adapted for adjusting the amount of torque required for rotation of the door, the detent hinge further including a predetermined number of apertures formed in the outer surface of the pin assembly adapted for releasably receiving the predetermined number of bearing members.

12. The detent hinge according to claim 11, wherein the means for varying the predetermined number of bearing members and biasing means comprises a retaining member cooperatively associated with the outer surface of the base of the second hinge leaf and operatively movable relative thereto between an open position and a closed position, whereby when the retaining member is in the closed position, the retaining member covers the at least one opening through the base and into the detent knuckle of the second hinge leaf, whereby movement of the retaining member to the open position uncovers the at least one opening for providing access to the bearing members and biasing means for varying the predetermined number thereof disposed within the hinge assembly.

13. The detent hinge according to claim 12, whereby movement of the retaining member from the closed position to the open position provides access to the bearing members and biasing means disposed within the hinge assembly for insertion of a desired number of bearing members and biasing means therein, whereby upon insertion of the desired number of bearing members and biasing means, the retaining member is moved to the closed position.

14. The detent hinge according to claim 12, whereby movement of the retaining member from the closed position to the open position provides access to the bearing members and biasing means disposed within the hinge assembly for removal of a desired number of bearing members and biasing means, whereby upon removal of the desired number of bearing members and biasing means, the retaining member is moved to the closed position.

15. The detent hinge according to claim 12, whereby movement of the retaining member from the closed position to the open position provides access to the bearing members and biasing means disposed within the hinge assembly for insertion and removal of a desired number of bearing members and biasing means, whereby upon insertion and removal of the desired number of bearing members and biasing means, the retaining member is moved to the closed position.

16. The detent hinge according to claim 12, wherein the second hinge leaf comprises a plurality of openings extending through the base and into the detent knuckle, and the retaining member when in the closed position is adapted to cover the plurality of detent knuckle openings.

17. The detent hinge according to claim 16, wherein the retaining member when in the closed position is in engagement with the predetermined number of biasing means.

18. The detent hinge according to claim 17, wherein the retaining member is slidably engageable with the outer surface of the base of the second hinge leaf.

* * * * *